US011368773B2

(12) United States Patent
Stadler et al.

(10) Patent No.: US 11,368,773 B2
(45) Date of Patent: Jun. 21, 2022

(54) METHOD OF MANUFACTURING A HEARING DEVICE HOUSING, A PREFORM OF A HEARING DEVICE HOUSING, A HEARING DEVICE HOUSING AND A HEARING DEVICE

(71) Applicant: Sonova AG, Stafa (CH)

(72) Inventors: Matthias Stadler, Mannedorf (CH); Natasha Thumm, Wetzikon (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 16/485,859

(22) PCT Filed: Feb. 23, 2017

(86) PCT No.: PCT/EP2017/054186
§ 371 (c)(1),
(2) Date: Aug. 14, 2019

(87) PCT Pub. No.: WO2018/153457
PCT Pub. Date: Aug. 30, 2018

(65) Prior Publication Data

US 2020/0007969 A1 Jan. 2, 2020

(51) Int. Cl.
*H04R 1/10* (2006.01)
*H04R 25/00* (2006.01)

(52) U.S. Cl.
CPC ..... *H04R 1/1016* (2013.01); *H04R 1/1058* (2013.01); *H04R 25/658* (2013.01); *H04R 2225/023* (2013.01); *H04R 2225/025* (2013.01); *H04R 2225/77* (2013.01)

(58) Field of Classification Search
CPC combination set(s) only.
See application file for complete search history.

(56) References Cited

U.S. PATENT DOCUMENTS 4,800,636 A * 1/1989 Topholm ..... H04R 25/60 29/896.21
5,487,012 A * 1/1996 Topholm ..... H04R 25/652 700/163

(Continued)

FOREIGN PATENT DOCUMENTS

DE 10 2007 016 400 A1 10/2008
EP 2 037 702 A2 3/2009
EP 2 615 854 A1 7/2013

OTHER PUBLICATIONS

International Search Report for PCT/EP2017/054186 dated Sep. 22, 2017.
Written Opinion for PCT/EP2017/054186 dated Sep. 22, 2017.

(Continued)

*Primary Examiner* — Angelica M McKinney
(74) *Attorney, Agent, or Firm* — Pearne & Gordon LLP

(57) ABSTRACT

A method of manufacturing a hearing device housing including at least one opening. The method includes the steps of: designing a pre-model of the hearing device housing by 3D-modelling software, the pre-model including a protective structure covering the opening, the protective structure being prepared for removal; producing a preform of the hearing device housing based on the pre-model; and removing the protective structure thus providing the hearing device housing with the opening.

16 Claims, 4 Drawing Sheets

(56) References Cited

U.S. PATENT DOCUMENTS

| | | | | |
|---|---|---|---|---|
| 8,032,337 | B2 * | 10/2011 | Deichmann | H04R 1/1016 703/1 |
| 2002/0136420 | A1 * | 9/2002 | Topholm | B33Y 50/02 381/312 |
| 2002/0196954 | A1 | 12/2002 | Marxen | |
| 2003/0044036 | A1 * | 3/2003 | Masters | H04R 25/658 381/322 |
| 2003/0152242 | A1 * | 8/2003 | Marxen | H04R 25/658 381/312 |
| 2004/0071305 | A1 * | 4/2004 | Frederiksen | H04R 25/658 381/312 |
| 2008/0317270 | A1 * | 12/2008 | Nikles | H04R 25/658 381/322 |
| 2009/0067656 | A1 * | 3/2009 | Saltykov | B29C 64/106 381/328 |
| 2009/0123014 | A1 | 5/2009 | Nikles et al. | |
| 2011/0182451 | A1 * | 7/2011 | Vaarbroe | H04R 25/652 381/322 |
| 2017/0280260 | A1 * | 9/2017 | Stadler | H04R 25/652 |
| 2018/0085221 | A1 * | 3/2018 | Langhorn | B24B 31/003 |
| 2020/0252735 | A1 * | 8/2020 | Meier | H04R 31/00 |

OTHER PUBLICATIONS

Translation of First Office Action and Search Report for corresponding Chinese application No. 201780086903.8 dated Apr. 22, 2020.
Office Action afor corresponding European application No. 17 706 796.4 dated Aug. 5, 2020.
Translation of Office Action for corresponding Chinese application No. 201780086903.8 dated Mar. 17, 2021.

* cited by examiner

METHOD OF MANUFACTURING A HEARING DEVICE HOUSING, A PREFORM OF A HEARING DEVICE HOUSING, A HEARING DEVICE HOUSING AND A HEARING DEVICE

TECHNICAL FIELD

The present invention is related to a method of manufacturing a hearing device housing, a preform of a hearing device housing, a hearing device housing and a hearing device.

BACKGROUND OF THE INVENTION

Hearing devices are typically used to improve the hearing capability or communication capability of a user. A hearing device may pick up the surrounding sound with a microphone of the hearing device, processing the microphone signal thereby taking into account the hearing preferences of the user of the hearing device and providing the processed sound signal into a hearing canal of the user via a miniature loudspeaker, commonly referred to as a receiver. A hearing device may also receive sound from an alternative input such as an induction coil or a wireless interface.

A hearing device comprises a housing. If the hearing device is an In-The-Ear hearing device (ITE) or a custom shaped earpiece, the housing is individually formed to fit into an ear canal of a user. ITE's are known which can be equipped with a module rather than a faceplate. The module can comprise components such as a frame, battery door and electrical and mechanical parts, etc. The module can be mounted to the hearing device housing by inserting into an opening formed into the housing. The module can be releasably mounted to the hearing device housing by e.g. using a click-in mechanism, sealing, etc. In case of the hearing device is prepared to be equipped with a module, prior to the assembly, the hearing device housing can be processed, e.g. by means of surface finishing. If the hearing device comprises a custom shaped earpiece the housing comprises an opening which for example allows insertion of a receiver or a sound tube.

As mentioned above, the module can be inserted into the hearing device housing opening, which requires to accordingly model the opening to the hearing device housing. Any gaps which are possibly present between the hearing device housing and the module, e.g. resulting from tolerances during a printing process of the hearing device housing, can be filled up with e.g. a sealing material, etc.

In an example, titanium can be selected as a metal for manufacturing the hearing device housing to be equipped with the module. Titanium is a high strength material which shows excellent characteristics. In an example, housings made of titanium can be as thin as 0.2 mm. Further, titanium is a high durable metal and shows improved resistance against entrance of e.g. liquids.

Hearing device housings made of titanium can be manufactured by using additive manufacturing technologies. However, said housings can exhibit rough surfaces that are inappropriate for being directly inserted into the ear canal of the user. It is known to apply surface treatment processes, e.g. manual grinding, in order to smoothen the housing surfaces such to achieve defined surface properties. However, manual grinding of hearing device housings which are made of titanium is a laborious process which requires additional steps, increased time and thus incurs high costs.

It is known in the art to process or rather finish the surface of a hearing device housing made of titanium by using abrasive media, e.g. vibratory grinding, centrifugal disc finishing, etc. In doing so, manual work, e.g. manual grinding, can be reduced or rather eliminated. Additionally, a process using sandblasting can be applied for further surface finishing.

However, using vibratory grinding on hollow parts can increase the risk of clogging with abrasive media which have entered the hearing device housing via the opening. It is very hard or even impossible to remove abrasive media clogged into the hearing device housing without e.g. damaging the latter. As a remedy, in order to prevent clogging, large to very large abrasive media could be used. However, this is limiting the choice of abrasive media for the manufacturer. Further, generally larger abrasive media cannot reach undercuts, which results in an inhomogeneous surface treatment.

A further problem in the state of the art is that the periphery of the opening, which is formed into the housing, is strongly exposed to the outside and thus to the abrasive media during grinding. This can result in an overly strong abrasion of this area (periphery of the opening) compared to the rest of the housing. This can result in a sort of wavy, imprecise opening.

A further problem in the state of the art is that, having an opening in an otherwise enclosed part can result to imprecisions during the additive manufacturing process since internal thermal stress produces warpage.

Document EP 2 037 702 A2 describes using a finishing plug for a hearing device shell. This plug is inserted into the opening of the shell after manufacturing thereof but prior to surface treating. After surface treating, the plug is removed. It is a problem that inserting the plug into the opening and removing the plug after surface treating are laborious processes incurring high costs. It is also a problem, that with e.g. metal printing, the tolerances of both parts add up and the plug could not fit into opening. Therefore, it could be necessary that the parts have to be grinded prior to insertion. This process can lead to increased laborious work, incurring high costs.

It is an object of the present invention to provide a method of manufacturing a hearing device housing, a preform of a hearing device housing, a hearing device housing and a hearing device solving the problems known in the state of the art.

SUMMARY OF THE INVENTION

The present invention is directed to a method of manufacturing a hearing device housing comprising at least one opening. The method comprises the step of designing a pre-model of the hearing device housing by means of a 3D-modelling software, said pre-model comprising a protective structure covering said opening, said protective structure being prepared for removal. The method further comprises the steps of producing a preform of the hearing device housing based on the pre-model, and removing the protective structure thus providing the hearing device housing with the opening. Hence, provided is a hearing device housing which is formed from a preform having the opening covered by a protective structure which is printed (integrally) with the preform. This protective structure covers the opening and thus prevents entrance of abrasive media during surface treating, e.g. vibratory grinding. Subsequent to surface treating, the protective structure is removed. The opening can be modeled into the preform of different preform geometries via the 3D-modelling software. The 3D-modelling software can be e.g. a RSM (Rapid Shell Modeling) software. With e.g. RSM software, the hearing device housing can be designed digitally ("designing a pre-model of the hearing device housing"), resulting in hearing devices that can be manufactured fast and more accurately. In an example, the position of the protective structure in or around uniform openings can be identical for each housing.

Further advantages and features of the protective structure comprise:

- The protective structure can be used as internal support which can improve the accuracy of the printed opening.
- The protective structure can avoid entrance of abrasive media, e.g. vibratory grinding stones, into the housing while surface treating.
- The dimension of the connections between the preform and the protective structure is chosen such to withstand the surface treating process, but to allow removing the protective structure easily afterwards by breaking it out, e.g. manually by a tool.
- The protective structure has a specific design, so that it can be printed in any orientation on the building platform around the opening. Therefore, the print-position of the hearing aid housing on the platform is not restricted and can be chosen in respect to the shape of the housing.

In an embodiment of the proposed method the protective structure at least in a periphery thereof is formed with recesses. Therefore, the protective structure is connected to the housing by spaced-apart connection points which are continuously arranged along the opening of the housing. This allows to easily remove the protective structure from the housing by simply breaking out the protective structure at its connection points (along the recessed portion). The dimension of the connecting points can be approximately 0.15 mm×0.15 mm. Removing the protective structure from the housing can be achieved simply by hand or by using a tool.

In an embodiment of the proposed method the protective structure comprises apertures. The apertures can be dimensioned such to prevent entrance of abrasive media during grinding.

In an embodiment of the proposed method the producing step comprises surface treating of the preform. In an embodiment, the surface treating step comprises a process using abrasive media. In an embodiment, the surface treating step comprises vibratory grinding.

In an embodiment of the proposed method the removing step comprises breaking out the protective structure from the preform. The connecting points of the protective structure can be designed such to withstand surface treating, e.g. vibratory grinding, but can be easily removed afterwards by breaking out the protective structure, e.g. manually. The dimension of the connecting points can be approximately 0.15 mm×0.15 mm. The thickness of the protective structure can be approximately 0.15 mm. After removing the protective structure from the preform, the preform can assume the hearing device housing.

In an embodiment, the method further comprises the step of: subsequently to the removing step, trimming remaining connection points from the inner rim and/or periphery of the opening. In an embodiment, the remaining connection points are trimmed by means of milling and/or grinding. The remaining connection points can also be referred as spikes. In an example, the remaining connection points can be left on the periphery of the opening for use of an improved support of the module once inserted. In this example, the remaining connection points or rather spikes can pinch into the material of the module during insertion.

In an embodiment of the proposed method the protective structure substantially extends parallel to a plane defined by the opening.

In an aspect of the embodiment, in a region surrounding the opening, the top surface of the protective structure is formed inwardly displaced from the top surface of the preform. Therefore, the protective structure is less exposed to the abrasive material during grinding. This allows the protective structure to suffer less wear.

In another aspect of the embodiment, in a region surrounding the opening, a portion of the periphery of the protective structure is directly positioned onto the top surface of the preform.

In another aspect of the embodiment, in a region surrounding the opening, a portion of the periphery of the protective structure is located onto the top surface of the preform via interposed platforms.

In an example, the protective structure may be designed flush with the surface of the housing at the border of the opening or designed to be slightly elevated over the surface of the housing.

In an embodiment, the hearing device housing is made of a metal comprising titanium. In a further embodiment, the protective structure on a top surface thereof is provided with a labelling. The labelling may comprise a code. The code can comprise information about the hearing device housing ID. The labeling can be applied as part of the designing step. Further, the code can comprise information about how to process the hearing device housing, e.g. the diameter of holes to be drilled into the housing, etc.

In an embodiment, the wall thickness of the hearing device housing is 0.2 mm or less.

Moreover, the present invention is directed to a preform of a hearing device housing. The inventive preform is produced based on a pre-model of the hearing device housing designed by means of a 3D-modelling software, wherein said pre-model comprises a protective structure covering an opening, said protective structure being prepared for removal. Hence, provided is a preform which can be surface-treated by using abrasive media without clogging the interior of the preform. After the surface treatment process, the protective structure is removed such to provide the hearing device housing.

In an embodiment, the periphery of the protective structure comprises recesses. Therefore, the protective structure can be removed from the housing easily.

Moreover, the present invention is directed to a hearing device housing manufactured by a method according to the claims.

Moreover, the present invention is directed to a hearing device comprising a hearing device housing according to the claims.

It is expressly pointed out that any combination of the above-mentioned embodiments is subject of further possible embodiments. Only those embodiments are excluded that would result in a contradiction.

BRIEF DESCRIPTION OF THE DRAWINGS

The present invention is further described with reference to the accompanying drawings jointly illustrating various exemplary embodiments which are to be considered in connection with the following detailed description. What is shown in the figures is.

DETAILED DESCRIPTION OF THE INVENTION

Figure 1:
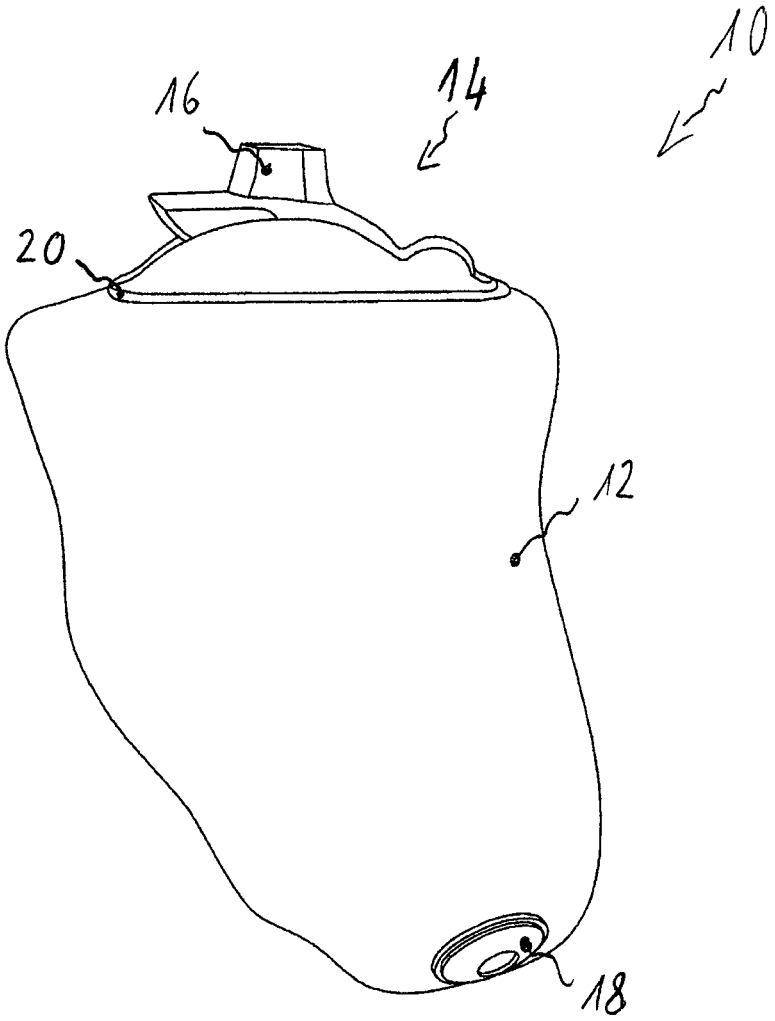
FIG. 1 is a perspective view of a hearing device comprising a module received into a housing.

FIG. 1 depicts a hearing device 10 in a perspective view. The hearing device 10 is an In-The-Ear (ITE) hearing device. Of course, other hearing device types can be used, as well. In the shown example, the housing 12 of the hearing device 10 is made of titanium. One of a plurality of advantages in using titanium is the ability of creating housings which are very thin while still showing increased strength. The hearing device 10 further comprises a module 14 which is inserted into an opening formed into the hearing device housing 12. The module 14 can be mounted to the hearing device housing 12 by means of sealing. The module 14 can be pre-assembled, comprising a battery compartment which openable end thereof is for receiving a battery (not shown). The openable end can be opened and closed via a battery door 16. The FIG. 1 shows the battery door 16 being closed. The battery door 16 can be opened to exchange a used battery as well as for service, maintenance, etc. Next to the battery, the module 14 can further comprise at least one microphone, a GMR switch, processing means, etc. The module 14 can be easily pre-assembled to the hearing device housing 12. The hearing device 10 further comprises a sound outlet 18 for outputting sound from a receiver (not shown) of the hearing device 10 to the ear canal of the user. The module 14 comprises an outer rim 20 which abuts against the periphery of an opening of the hearing device housing 12 once inserted.

Figure 2:
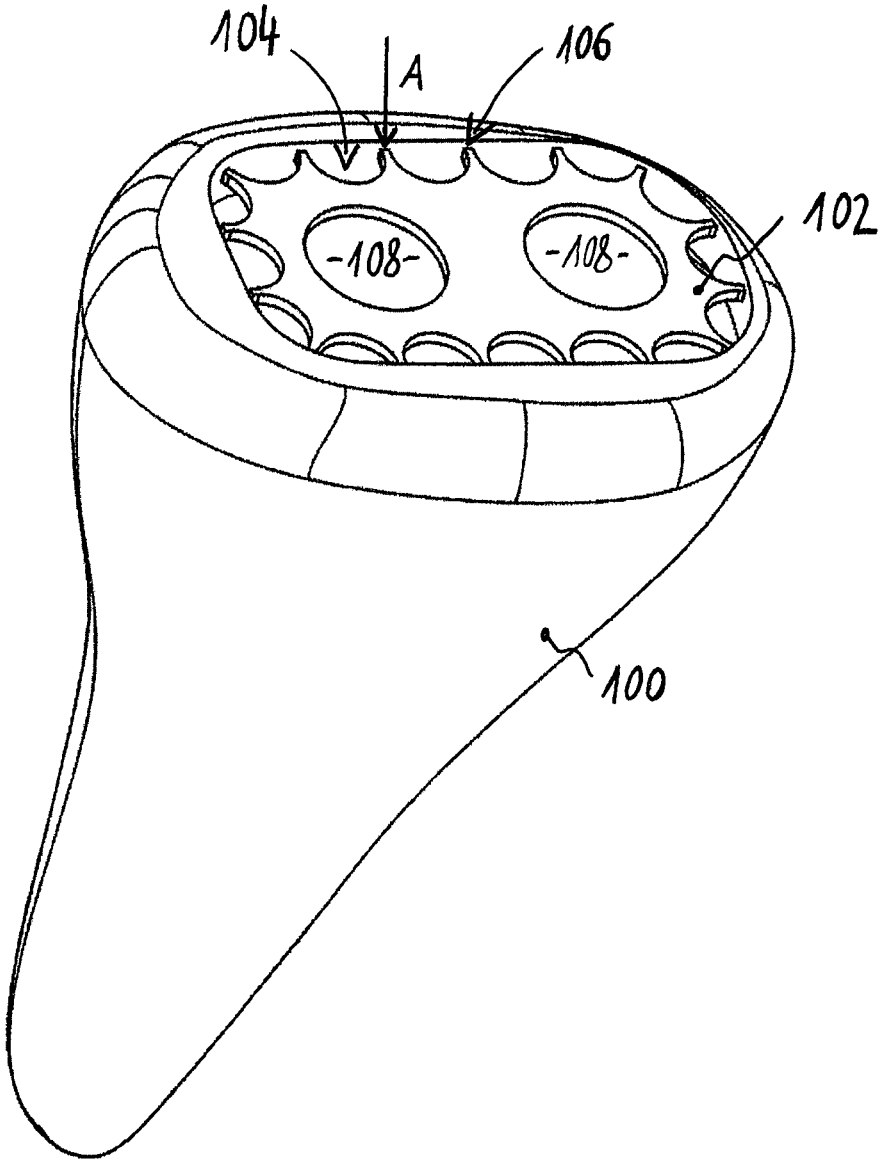
FIG. 2 is a perspective view of a preform of a hearing device housing according to the invention, FIGS. 3A and 3B schematically depict protective structures in different aspects, and FIG. 4 schematically depicts a hearing device housing which is clogged with abrasive media according to the prior art.

FIG. 2 depicts a preform 100 of a hearing device housing according to the invention. The hearing device housing can be embodied as the hearing device housing as shown in FIG. 1. The preform 100 comprises a protective structure 102 covering the opening of the preform 100. Designing the protective structure 102 is part of the step of designing a pre-model of the hearing device housing by means of a 3D-modelling software. In a next step, the preform 100 of the hearing device housing is produced based on the pre-model. The protective structure 102 is formed to be prepared for removal in a later stage.

In an aspect, which is also illustrated in FIG. 2, the protective structure 102 is at least in a periphery thereof formed with recesses 104. The recesses 104 allow that the protective structure 102 is connected to the preform 100 solely by (remaining) connecting points 106. Therefore, in a later stage, the protective structure 102 can be removed by simply breaking out the protective structure 102 (by its connection points 106) from the preform 100. In other words, the protective structure 102 can be removed by simply breaking the connection points 106 thus disconnecting the protective structure 102 from the preform 100.

The preform 100 can be surface-treated by means of a process using abrasive media, e.g. vibratory grinding (not shown). After termination of the surface treatment process, the protective structure 102 is removed (not shown) as a sacrificial structure thus providing the hearing device housing (with the opening). The protective structure 102 can comprise apertures 108. The apertures 108 can allow to compensate for tolerances which possibly arise during manufacturing of the preform 100 and/or protective structure 102.

The protective structure 102 can be formed such to substantially extend parallel to a plane defined by the opening. As depicted in the FIG. 2, in a region surrounding the opening, the top surface of the protective structure 102 can be formed inwardly displaced from the top surface of the preform 100 in a direction as indicated by an arrow A. In this case, the edges of the protective structure 102 are not flush with the surface of the preform 100 at the border of the opening but are slightly inwardly displaced and therefore will be less exposed during a following mechanical surface treating step. While not shown, in the region surrounding the opening, a portion of the periphery of the protective structure can be directly positioned onto the top surface of the preform 100. In another example, while not shown, in a region surrounding the opening, a portion of the periphery of the protective structure can be located onto the top surface of the preform 100 via interposed platforms.

Subsequently to the step of removing the protective structure 102 from the preform 100, residuals of the (former) connection points 106 remaining on the hearing device housing can be eliminated from the inner rim and/or periphery of the opening by trimming, e.g. by means of milling, grinding, etc.

Figure 3A:
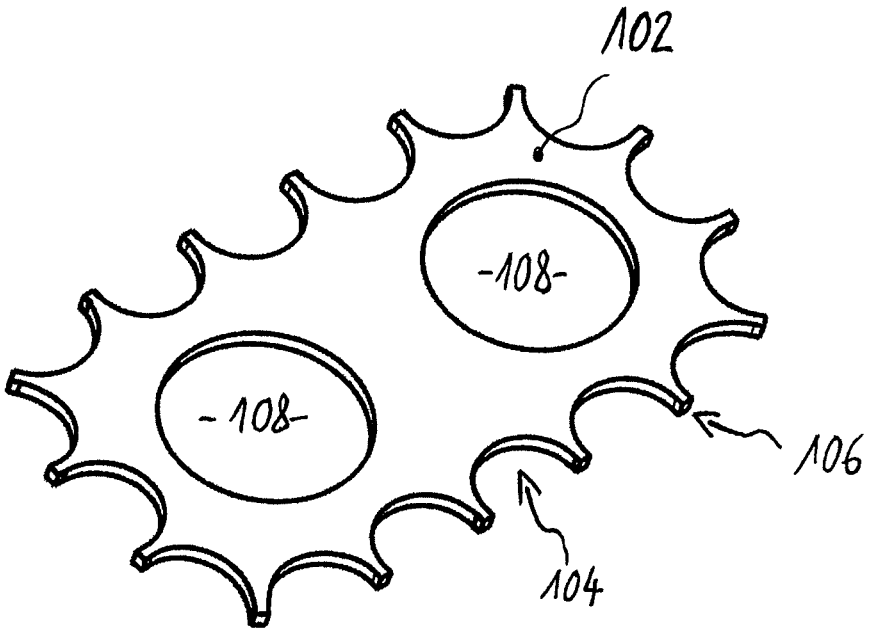
Figure 3B:
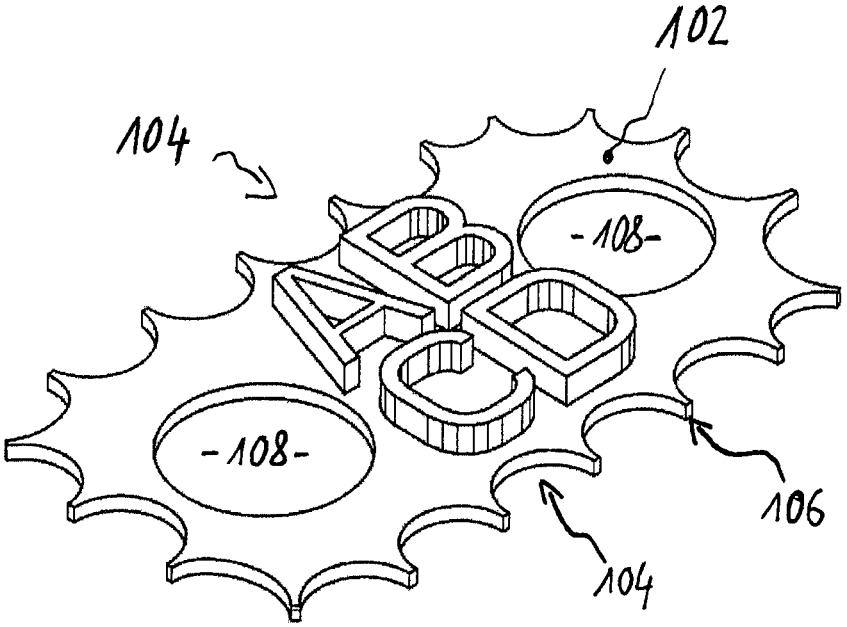

FIGS. 3A,B schematically depict the protective structure 102 in different aspects of the invention. The thickness of the protective structure 102 can be selected such to withstand the surface treatment process. In an example, the thickness can vary between 0.1 to 0.15 mm. The protective structure 102 can be removed after the surface treatment process manually by using a tool or just by hand. As shown in FIG. 3B, the protective structure 102 can be provided with a code 110 which can bear information, e.g. an ID of the hearing device, an information about how to process the housing, etc. The protective structure 102 can be provided with apertures 108.

Figure 4:
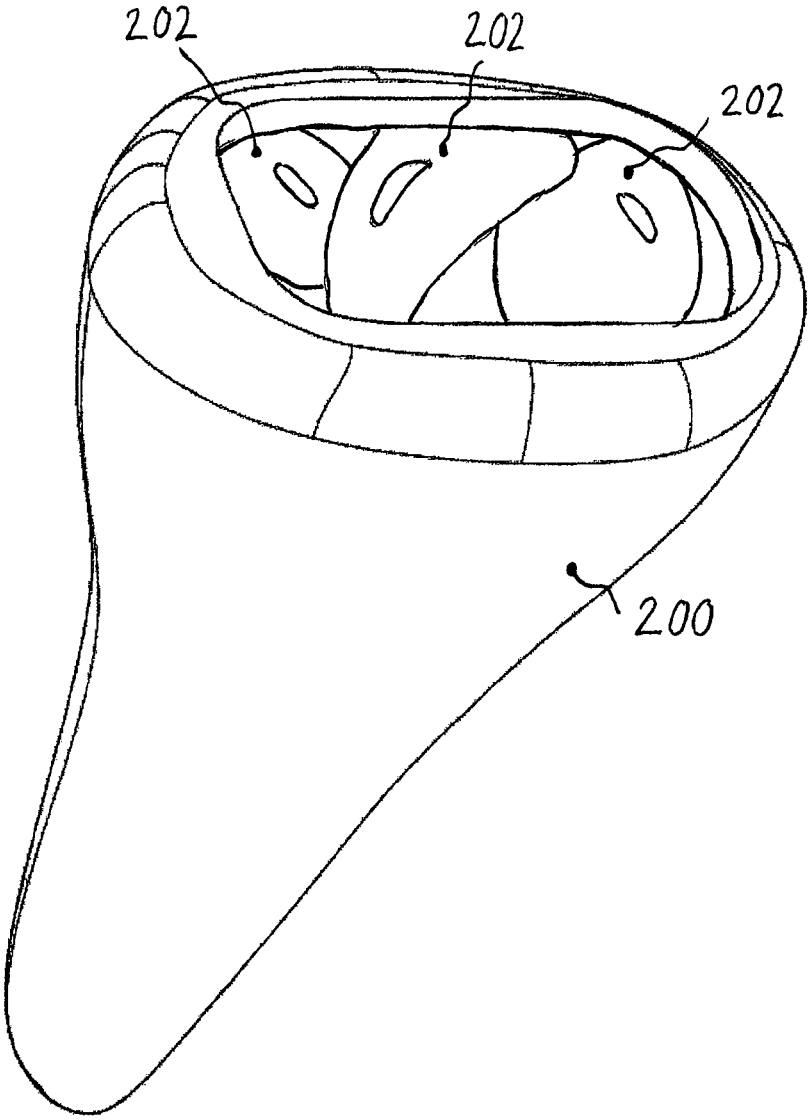

FIG. 4 schematically depicts a hearing device housing 200 according to the prior art, wherein the housing 200 is clogged inside with grinding stones 202 of abrasive media. In this prior art example, during surface treatment of the housing 200, the grinding stones 202 are entered the housing 200 via the opening thereof. The surface treatment can comprise e.g. vibratory grinding. Generally, removal of the clogged grinding stones 202 out of the hollow body of the housing 200 is impossible at least without damaging of the housing 200. Any efforts to do so would be inefficient. A further problem is an overly strong abrasion of the exposed area surrounding the opening (periphery of the opening), which might result in a wavy, imprecise opening.

What is claimed is:

1. A method of manufacturing a hearing device housing comprising at least one opening, said method comprises the steps of:

designing a pre-model of the hearing device housing by means of a 3D-modelling software, said pre-model comprising a protective structure covering said opening against entrance of abrasive media, said protective structure being prepared for removal by designing the protective structure connected to the housing by spaced-apart connection points, producing a preform of the hearing device housing based on the pre-model such that the connection points extend from the protective structure to the hearing device housing and are formed integrally with the protective structure and the hearing device housing, said hearing device housing is made of a metal comprising titanium, thereafter, surface treating of the preform by means of vibratory grinding using the abrasive media, wherein during said surface treating of the preform, the connection points remain integrally formed with the protective structure and the hearing device housing, and subsequently removing the protective structure from the hearing device housing by separating the connection points from the hearing device housing or from the protective structure, thus providing the hearing device housing with the opening.

2. The method according to claim 1, wherein the protective structure at least in a periphery thereof is formed with recesses.

3. The method according to claim 1, wherein the protective structure comprises apertures.

4. The method according to claim 1, wherein the removing step comprises breaking out the protective structure from the preform.

5. The method according to claim 1, further comprising the step of:

subsequently to the removing step, trimming remaining connection points from an inner rim and/or a periphery of the opening.

6. The method according to claim 5, wherein the remaining connection points are trimmed by means of milling and/or grinding.

7. The method according to claim 1, wherein the protective structure extends parallel to a plane defined by the opening.

8. The method according to claim 1, wherein, in a region surrounding the opening, a top surface of the protective structure is formed inwardly displaced from a top surface of the preform.

9. The method according to claim 1, wherein, in a region surrounding the opening, a portion of a periphery of the protective structure is directly positioned onto a top surface of the preform.

10. The method according to claim 1, wherein, in a region surrounding the opening, a portion of a periphery of the protective structure is located onto a top surface of the preform via interposed platforms.

11. The method according to claim 1, wherein the protective structure on a top surface thereof is provided with a labelling.

12. The method according to claim 1, wherein a wall thickness of the hearing device housing is 0.2 mm or less.

13. A hearing device housing manufactured by a method according to claim 1.

14. A hearing device comprising a hearing device housing according to claim 13.

15. A preform of a hearing device housing made of a metal comprising titanium, wherein said preform is produced based on a pre-model of the hearing device housing designed by means of a 3D-modelling software, wherein:

said pre-model comprises a protective structure covering an opening against entrance of abrasive media, said protective structure being prepared for removal by designing the protective structure connected to the housing by spaced-apart connection points, wherein the protective structure is configured to be removed from the housing after a surface treating operation by separating the connection points from the housing or from the protective structure, and wherein during said surface treating operation, the connection points extend from the protective structure to the hearing device housing and are formed integrally with the protective structure and the hearing device housing.

16. The preform of claim 15, wherein a periphery of the protective structure comprises recesses.

* * * * *